US010808545B2

(12) United States Patent
El-Wardany et al.

(10) Patent No.: US 10,808,545 B2
(45) Date of Patent: Oct. 20, 2020

(54) GAS TURBINE ENGINE FAN BLADE, DESIGN, AND FABRICATION

(71) Applicant: United Technologies Corporation, Farmington, CT (US)

(72) Inventors: Tahany Ibrahim El-Wardany, Bloomfield, CT (US); Matthew E. Lynch, Canton, CT (US); Om P. Sharma, South Windsor, CT (US); Catalin G. Fotache, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 623 days.

(21) Appl. No.: 15/650,107

(22) Filed: Jul. 14, 2017

(65) Prior Publication Data

US 2019/0017388 A1 Jan. 17, 2019

(51) Int. Cl.
*F01D 5/18* (2006.01)
*F01D 5/14* (2006.01)
(Continued)

(52) U.S. Cl.
CPC ..... *F01D 5/183* (2013.01); *B22F 3/1115* (2013.01); *F01D 5/147* (2013.01); *F04D 29/023* (2013.01); *F04D 29/324* (2013.01); *F04D 29/388* (2013.01); *F05B 2260/203* (2013.01); *F05D 2220/36* (2013.01); *F05D 2230/31* (2013.01);
(Continued)

(58) Field of Classification Search
CPC ..... F01D 5/183; F01D 5/147; F04D 29/023; F04D 29/324; F04D 29/388; B22F 3/1115; F05D 2300/612; F05D 2220/36; F05D 2300/133; F05D 2300/121;
(Continued)

(56) References Cited

U.S. PATENT DOCUMENTS 3,844,011 A * 10/1974 Davies ..... B22F 3/1109 428/547
7,828,526 B2 * 11/2010 Cairo ..... F01D 5/147 416/224
(Continued)

FOREIGN PATENT DOCUMENTS

EP 2243292 A2 10/2010
EP 2633942 A2 9/2013
WO 2015/009448 A1 1/2015

OTHER PUBLICATIONS

Extended European Search Report for EP Application No. 18183784.0, dated Nov. 15, 2018, 8 pages.

*Primary Examiner* — Jacob M Amick
(74) *Attorney, Agent, or Firm* — Kinney & Lange, P.A.

(57) ABSTRACT

An embodiment of a fan blade includes an interior region between a metallic pressure sidewall and a metallic suction sidewall. Each sidewall extends in span from a base to a tip, and extends in chord from a leading edge to a trailing edge. The interior region of the fan blade includes a first fully dense metallic portion and a first porous metallic portion. The first fully dense metallic portion has a volume occupying at least 10% of a total volume of the interior region, and substantially no porosity. The first porous metallic portion is integrally joined to the fully dense metallic portion, and is selected from a structured lattice, an unstructured foam, and combinations thereof.

21 Claims, 7 Drawing Sheets

(51) Int. Cl.

| | |
|---|---|
| ***F04D 29/38*** | (2006.01) |
| ***B22F 3/11*** | (2006.01) |
| ***F04D 29/02*** | (2006.01) |
| ***F04D 29/32*** | (2006.01) |

(52) U.S. Cl.
CPC .. *F05D 2240/305* (2013.01); *F05D 2240/306* (2013.01); *F05D 2300/121* (2013.01); *F05D 2300/133* (2013.01); *F05D 2300/514* (2013.01); *F05D 2300/612* (2013.01)

(58) Field of Classification Search
CPC ..... F05D 2300/514; F05D 2240/306; F05D 2240/305; F05D 2230/31; F05B 2260/203
See application file for complete search history.

(56) References Cited

U.S. PATENT DOCUMENTS

| | | | | |
|---|---|---|---|---|
| 9,004,873 | B2 | 4/2015 | Rice | |
| 9,470,095 | B2 | 10/2016 | Propheter-Hinckley et al. | |
| 2003/0185685 | A1* | 10/2003 | Simon | F01D 5/147 416/229 R |
| 2006/0285975 | A1* | 12/2006 | Landis | F01D 5/147 416/97 R |
| 2007/0274854 | A1* | 11/2007 | Kelly | B22F 3/114 419/2 |
| 2013/0195671 | A1* | 8/2013 | El-Wardany | F01D 5/286 416/229 R |
| 2015/0064016 | A1* | 3/2015 | Cortequisse | B22F 5/04 416/230 |
| 2016/0047248 | A1 | 2/2016 | Wallis et al. | |
| 2016/0115822 | A1* | 4/2016 | Cortequisse | B22F 7/004 415/200 |
| 2016/0230662 | A1 | 8/2016 | Kostka, Jr. et al. | |

* cited by examiner

GAS TURBINE ENGINE FAN BLADE, DESIGN, AND FABRICATION

BACKGROUND

This disclosure relates generally to titanium and/or aluminum fan blades for gas turbine engines, and more specifically to internal and external configurations of such blades, including methods for design and fabrication.

Currently large hollow aluminum fan blade is composed of multiple components that are assembled together using a special adhesive and metallurgical bonding process. The hollow blade has a number of cast hollow channels which include light weight filler. A separately formed cover is typically adhesively bonded to the main body to enclose the remaining hollow fan blade, and the cover is welded to the main body only around the outer edge joints, near the perimeter of the selected sidewall. The application and inspection of the adhesive and post treatment for assembling the cover can be time consuming.

SUMMARY

An embodiment of a fan blade includes an interior region between a metallic pressure sidewall and a metallic suction sidewall. Each sidewall extends in span from a base to a tip, and extends in chord from a leading edge to a trailing edge. The interior region of the fan blade includes a first fully dense metallic portion and a first porous metallic portion. The first fully dense metallic portion has a volume occupying at least 10% of a total volume of the interior region, and substantially no porosity. The first porous metallic portion is integrally joined to the fully dense metallic portion, and is selected from a structured lattice, an unstructured foam, and combinations thereof.

An embodiment of a method includes forming a metallic pressure sidewall or a metallic suction sidewall, the sidewall extending in span from a base to a tip, and extending in chord from a leading edge to a trailing edge. A first fully dense metallic portion having substantially no porosity is deposited. A first porous metallic portion is deposited and integrally joined to the fully dense metallic portion. The first porous metallic portion is selected from a structured lattice, an unstructured foam, and combinations thereof. The first fully dense metallic portion and the first porous metallic portion are metallurgically secured to an interior surface of the pressure or suction sidewall, defining at least part of an interior airfoil region.

DETAILED DESCRIPTION

This disclosure describes a novel fan blade design that is composed of an interior region such as a lattice, and a skin of titanium and/or aluminum alloys, as well as methods of design and fabrication thereof. The fan blade construction is composed of a topology optimized lattice core design and as explained below, can improve performance and functionality integration for the fan blade through enhancing bending strength and foreign object damage (FOD) resistance while reducing the weight and tailoring the natural frequencies. Powder based or wire based additive manufacturing processes or investment casting can be used to fabricate the 3-D lattice. The selection of fabrication process parameters will be dependent on the materials and lattice geometry. Another option is to replace or supplement the lattice with a stochastic foam core. In each case, a skin can be deposited using metal additive manufacturing (AM)/3D printing processes such as powder directed energy deposition; powder bed fusion; wire directed energy deposition, electron beam additive manufacturing (EBAM) for titanium; and solid state additive manufacturing processes.

Figure 1:
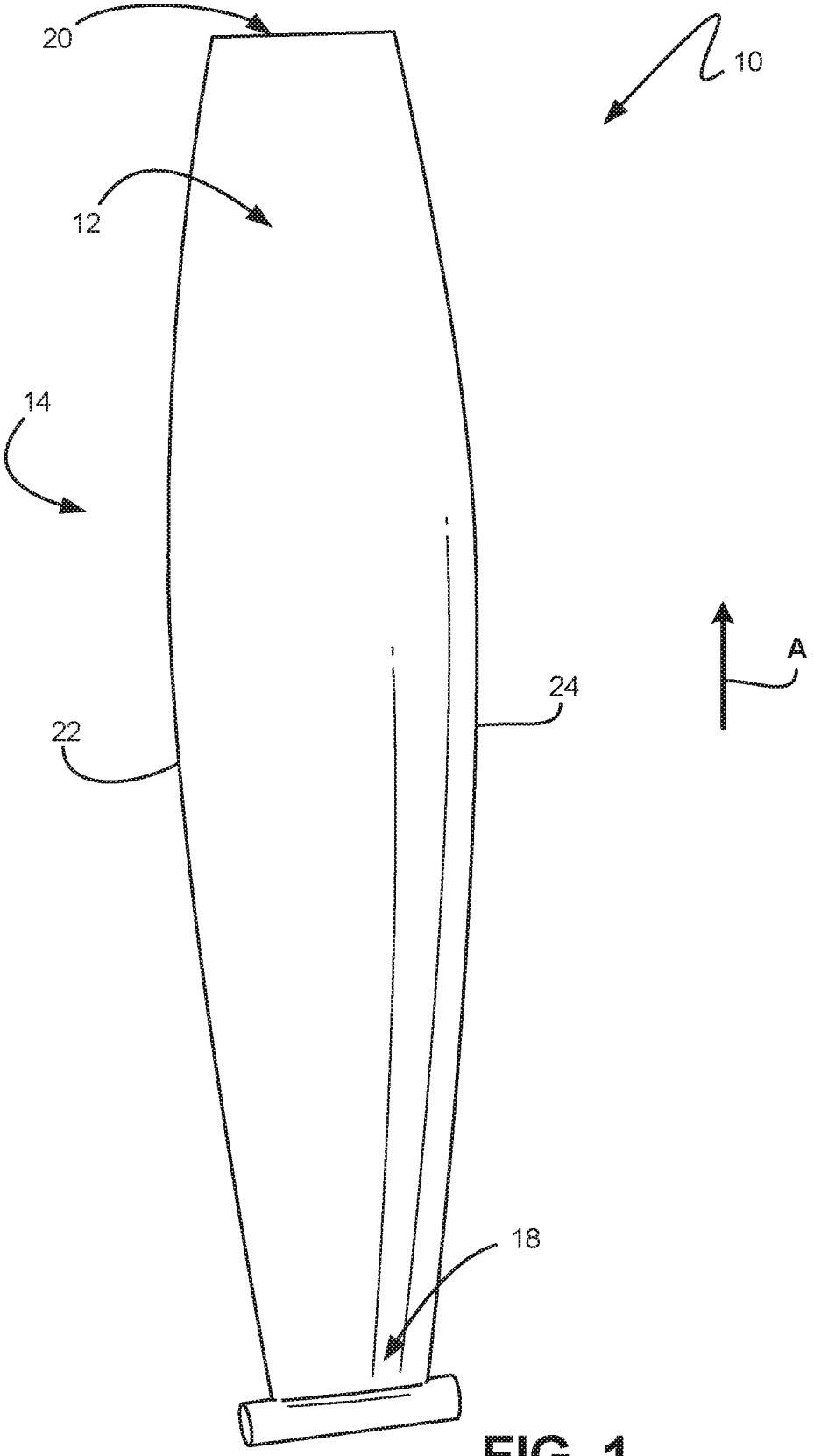
FIG. 1 is a first example fan blade embodiment for a gas turbine engine.

FIG. 1 shows a fan blade 10 including metallic pressure sidewall 12 and metallic suction sidewall 14, each sidewall 12, 14 extending in span (along primary axis A) from base 18 to tip 20, and extending in chord from leading edge 22 to trailing edge 24. In certain embodiments, pressure sidewall 12 and the suction sidewall 14 each comprise an aluminum alloy, a titanium alloy, or a combination thereof.

Figure 2:
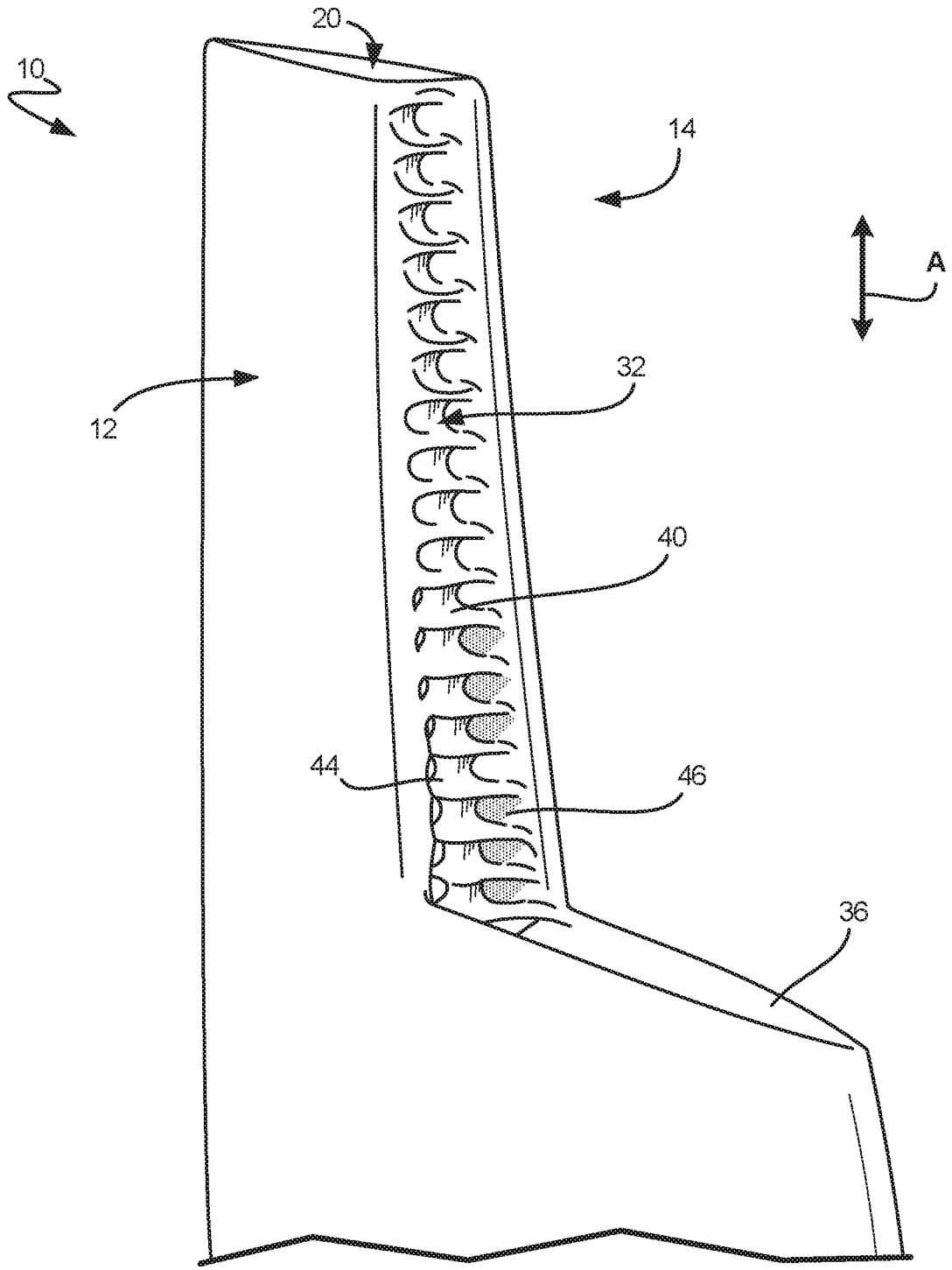
FIG. 2 is a partial cutaway section of the fan blade shown in FIG. 1.

FIG. 2 shows fan blade 10 shown in FIG. 1, a part of which is cut away to show interior region 32. Interior region 32, disposed between pressure and suction sidewalls 12, 14, can include one or more fully dense metallic portions 36 having a volume occupying at least 10% of a total volume of interior region 32. Fully dense metallic portion 36 has substantially no porosity so as to selectively provide local stiffness as well as strength in particularly vulnerable location (s) of blade 10. To save weight, interior region 32 can also include at least a first porous metallic portion 40, which can be integrally joined to at least a first fully dense metallic portion 36. As seen in subsequent figures, porous metallic portion(s) 40 can be selected from structured lattice 44, structured, unstructured, or stochastic foam 46, and combinations thereof.

Finished parts of the interior region 32, particularly structured lattice(s) 44, may sometimes be referred to as a lattice core. However, this should be distinguished from a casting core often used in investment casting processes. As will be appreciated below, finished parts of interior region 32 can be formed from investment casting, and may therefore utilize one or more casting cores (not shown) to arrive at the desired internal geometry; yet each "core" structure is different in both form and function.

Figure 3:
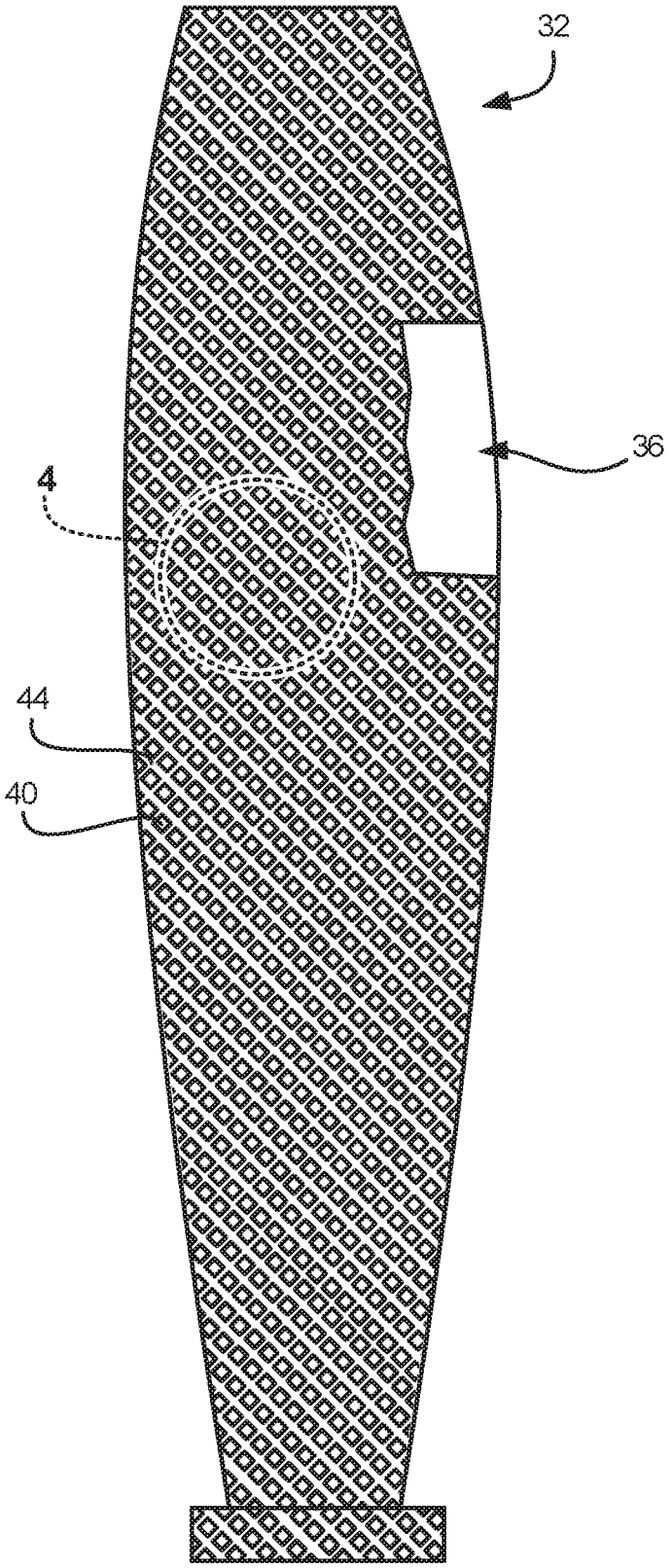
FIG. 3 schematically depicts an interior region of the fan blade, absent sidewalls.
Figure 4:
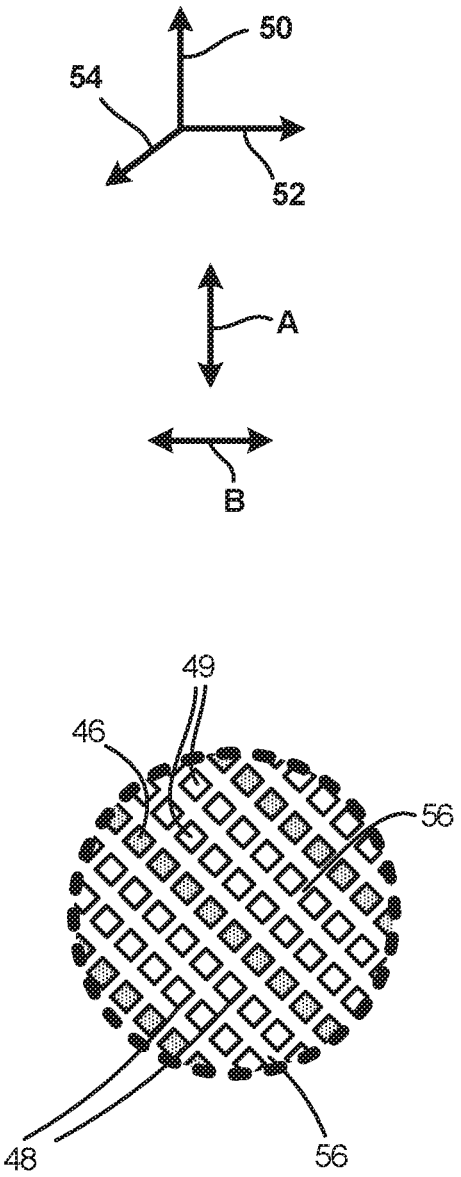
FIG. 4 shows a magnified portion of FIG. 3.

FIG. 3 shows interior region 32 of fan blade 10, while FIG. 4 shows a magnified portion thereof. As best seen in FIG. 4, the structured lattice includes a first plurality of lattice unit cells 49 defined by a first plurality of ligaments 56 connected at a first plurality of nodes 48. The first plurality of nodes 48 can be distributed in one, two, or all of the spanwise (primary axis A), chordwise, and thickness directions of fan blade 10. Open spaces or porosity around ligaments 48 and nodes 56 define open unit cells 49, whose size and shape, in turn, can also vary and be optimized depending on parameters described herein. And though not always apparent in certain figures, some or all of open unit cells 49 can be filled with structured, unstructured, or stochastic metallic foam 46.

As discussed earlier, it was noted that interior region 32, including one or more lattice cores, can be topology optimized for a particular use. This can include optimization of lattice density distribution field across the lattice core, manifested in varying thickness of lattice ligaments 56 and/or variable placement of nodes 48. Different types of lattice 48 unit cells 49 can be optimally distributed across the lattice core (that is, the topology and/or shape of the nodes 48 and/or constituent unit cells 49 can and often will vary from one portion of interior region 32 to another). Optimization of such shapes and sizes/volumes can be with respect to weight, structural stiffness and/or stress, lifing of the blade, natural frequency, energy absorption, thermal loadings, required thermal function, fluid flow, and many combinations thereof. Inputs to the optimization process are service design requirements (e.g., aero loadings) and manufacturing loading events.

For example, in certain embodiments, first porous metallic portion 44 has continuously variable porosity in at least one of spanwise direction 50, chordwise direction 52, or thickness direction 54. In most cases, primary blade axis A is generally or precisely aligned with spanwise direction 50. As nodes 48 are solid, each occupies a particular volume of interior region 32. As nodes 48 can potentially be formed via ligaments and unit cells of different sizes meeting at different angles throughout interior region 32, some nodes 48 (and resulting unit cells 49) will have different shapes and dimensions, resulting in some nodes 48 (and resulting unit cells 49) occupying different volumes than others. Often the first plurality of nodes 48 include nodes having a first volume and nodes having a second volume different from the first volume. As noted in the previous example, the interior topology (including the size of nodes 48/unit cells 49 and spacing between them) can be varied and reinforced to withstand the expected building and operational forces, to minimize weight, to tailor natural frequency, to absorb energy during FOD events, and/or to meet some other required function, taking advantage of advanced additive manufacturing processes for fabrication.

Similarly, ligaments 56 can include first ligaments having a first diameter and second ligaments having a second diameter different from the first diameter. In certain embodiments, diameter of adjacent ligaments varies along a length of a primary blade axis A or a primary build axis B. Additionally and/or alternatively, diameter of adjacent ligaments varies in a plane normal to a primary blade axis A or a primary build axis B (See FIG. 4). In yet other embodiments, ligament diameters vary along an expected loading path or axis (not shown). In addition to a particular ligament having constant diameter between adjacent nodes 48, one or more individual ligaments can vary in diameter along a single ligament length (either stepwise or continuous).

Figure 5:
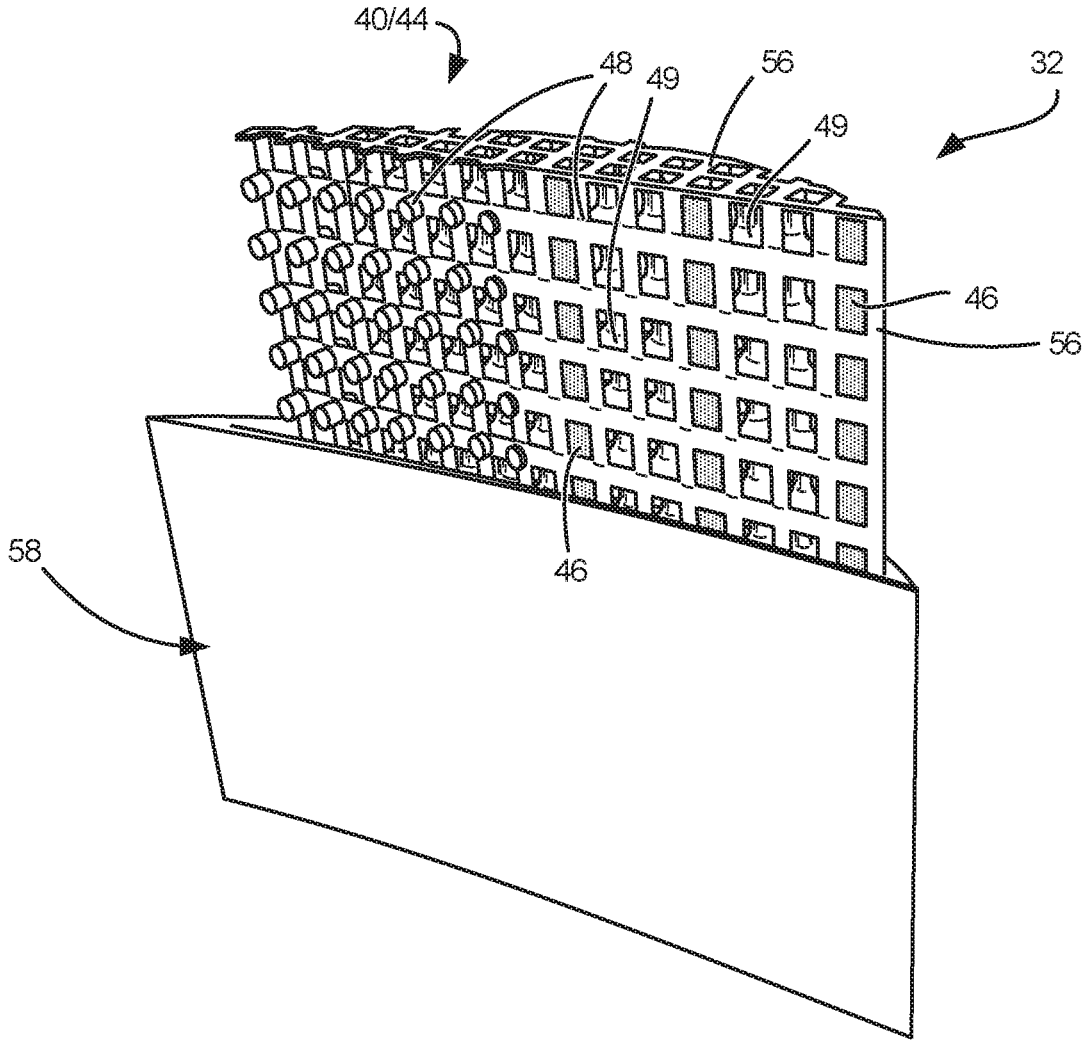
FIG. 5 depicts a skin being deposited onto a lattice core to form at least part of the fan blade sidewalls.

A skin 58 forms at least part of the pressure sidewall and/or the suction sidewall (shown in FIG. 1). Skin 58 can be metallurgically deposited onto at least the first porous portion 40/44 without adhesive. FIG. 5 shows how a skin layer 58 can be added to the lattice core (interior region 32) via one or more additive manufacturing processes. Pairs or groups of ligaments can converge at a node angle of up to 90° or another suitable (preferably acute) angle to minimize overhang with respect to the additive manufacturing build direction for skin 58. Deposition can use either solid state or powder/wire fusion additive manufacturing processes. The skin surface can be machined using 5-axis computerized numerical control (CNC) milling machine spindle. The exact process parameters will be defined based on the selected material for the skin and AM processes. In addition to deposition of either titanium or aluminum alloy skin 58, it can also be made of aluminum matrix composite. After deposition, high speed machining finishes the skin to the right dimension and required surface finish.

Figure 6:
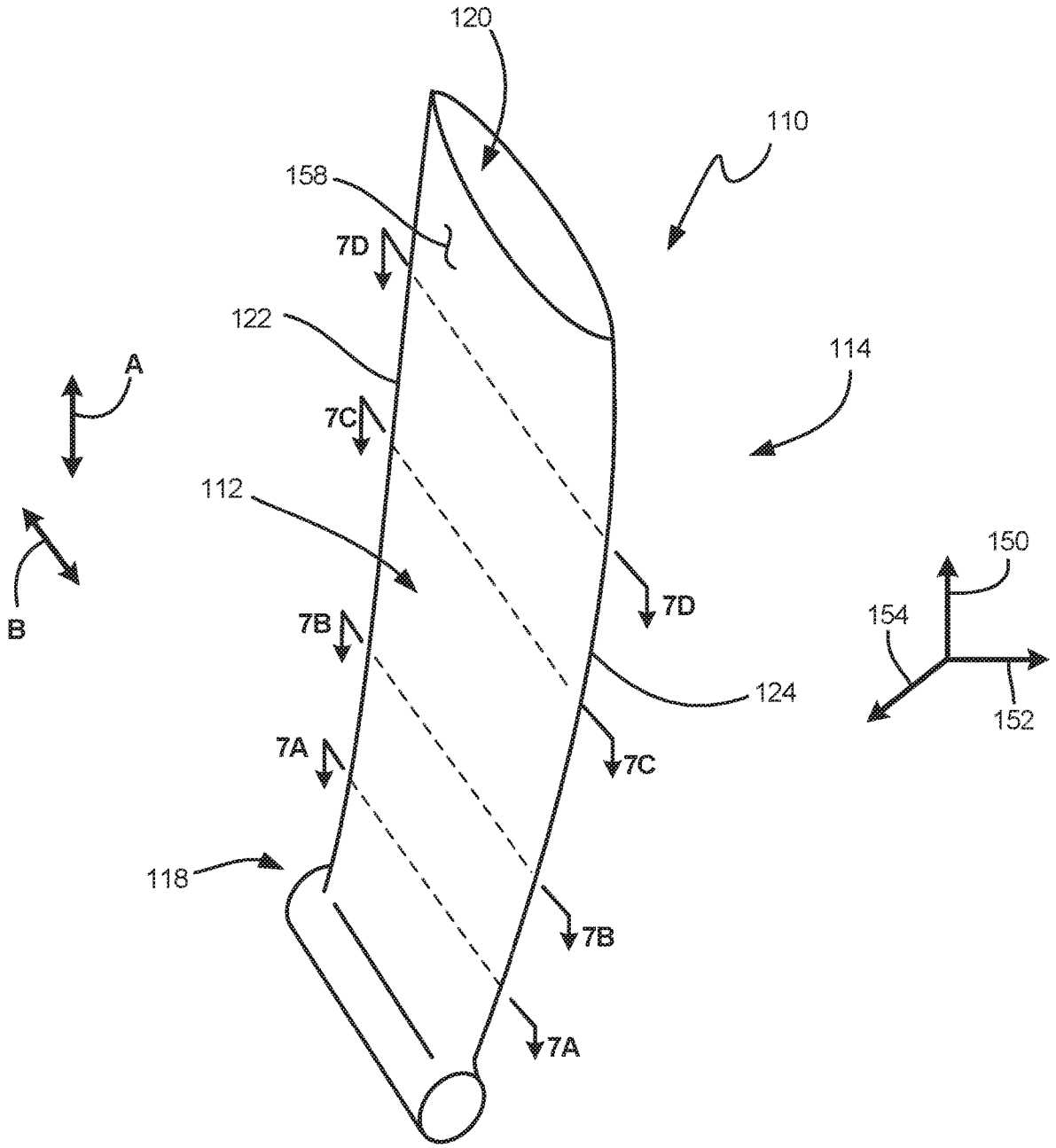
FIG. 6 is a second example fan blade embodiment for a gas turbine engine with a lattice core having variable topology throughout.

FIGS. 1-5 show a first, non-limiting example embodiment of fan blade 10. An interior region can be further optimized to enhance the fan blade performance and strength while reducing the blade weight and ensure stability during and after manufacture. FIG. 6 is a second, non-limiting example embodiment of fan blade 110, with four example spanwise sections (7A, 7B, 7C, and 7D) taken therethrough. Similar to fan blade 10 in FIG. 1, FIG. 6 shows fan blade 110 including metallic pressure sidewall 112 and metallic suction sidewall 114, each sidewall 112, 114 extending in span (along primary blade axis A) from base 118 to tip 120, and extending in chord from leading edge 122 to trailing edge 124. In certain embodiments, pressure sidewall 112 and the suction sidewall 114 each comprise an aluminum alloy, a titanium alloy, or a combination thereof.

Figure 7A:
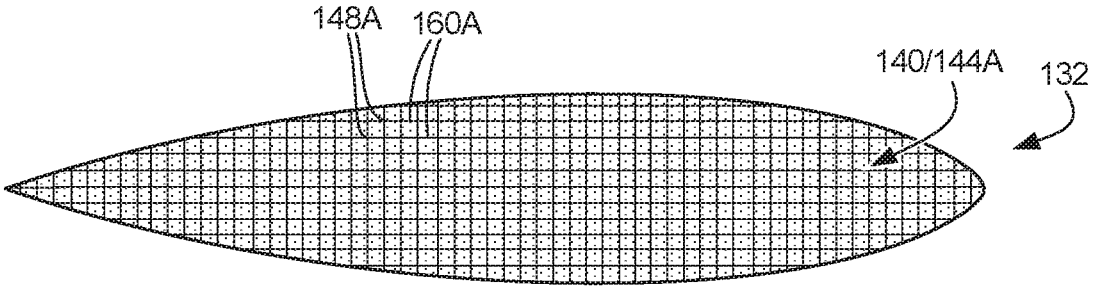
FIGS. 7A-7D are sectional views taken spanwise along the second example fan blade embodiment of FIG. 5.
Figure 7B:
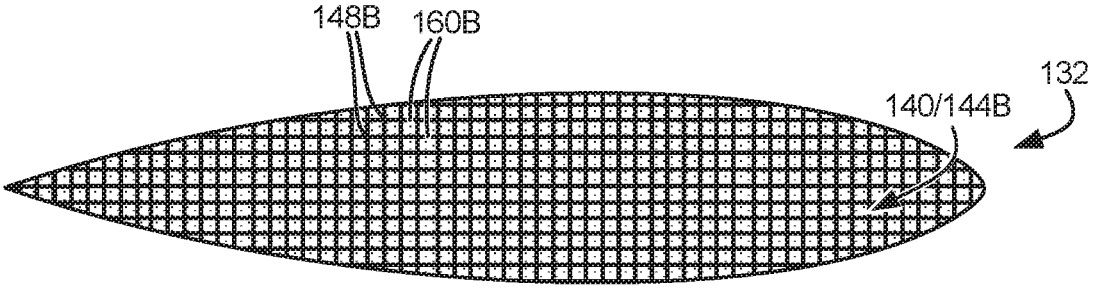

FIG. 7A shows a first blade section taken near root or base 118. FIG. 7B shows a second blade section taken outward of section 7A and base 118. In FIGS. 7A and 7B, interior region 132 includes first porous metallic portion 140 where structured lattice 144A varies in wall or ligament thickness in at least one blade direction (spanwise direction 150, chordwise direction 152, and/or thickness direction 154). Here wall or ligament thickness varies primarily in spanwise direction 150 (generally parallel to primary blade axis A), with first ligaments 160A in FIG. 7A having a first diameter and second ligaments 160B in FIG. 7B having a second diameter different from (larger than) the first diameter. This also results in larger nodes 148B, occupying more volume of structured lattice 144B (FIG. 7B) than a volume of structured lattice 144A occupied by nodes 148A (FIG. 7A). In certain embodiments, a ligament diameter varies along a length of primary build axis B. In yet other embodiments, a ligament diameter varies along another axis or axes (not shown).

Figure 7C:
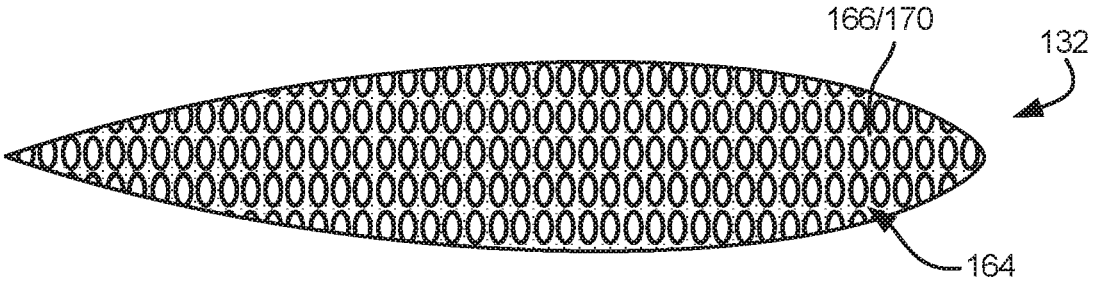

In FIG. 7C, a third example blade section, taken outward of section 7B, includes a second structured lattice 164 which produces directional channels 166. Here thickness of each channel 166 varies primarily along spanwise direction 150 (generally parallel to primary blade axis A). Channels 166 can be filled with stochastic metal foam 170.

Figure 7D:
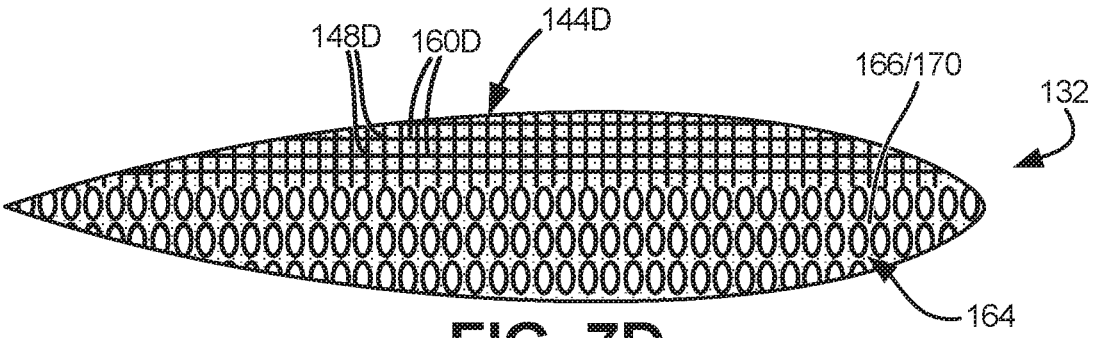

In FIG. 7D, a fourth example blade section taken inward of tip 120 is shown. This section combines the aspects shown in FIGS. 7A-7C, including structured lattice 144D and channels 166, each of which vary to accommodate both the high centrifugal and rubbing stresses experienced near tip 120, as well as to withstand the build stresses being laterally distant from build axis B. Structured lattice 164 produces directional channels 166 filled with foam 170 while structured lattice 144D includes ligaments 160D, meeting at nodes 148D. After forming interior region 132, skin 158 can be deposited thereon, according to other parts of this disclosure.

The present disclosure provides a novel approach for designing the fan blade to enhance its performance with cost effective fabrication and simplified assembly. Processing and inspection times can also be reduced, while finished material properties will often be the same or better than that derived from current processes.

Figure 8:
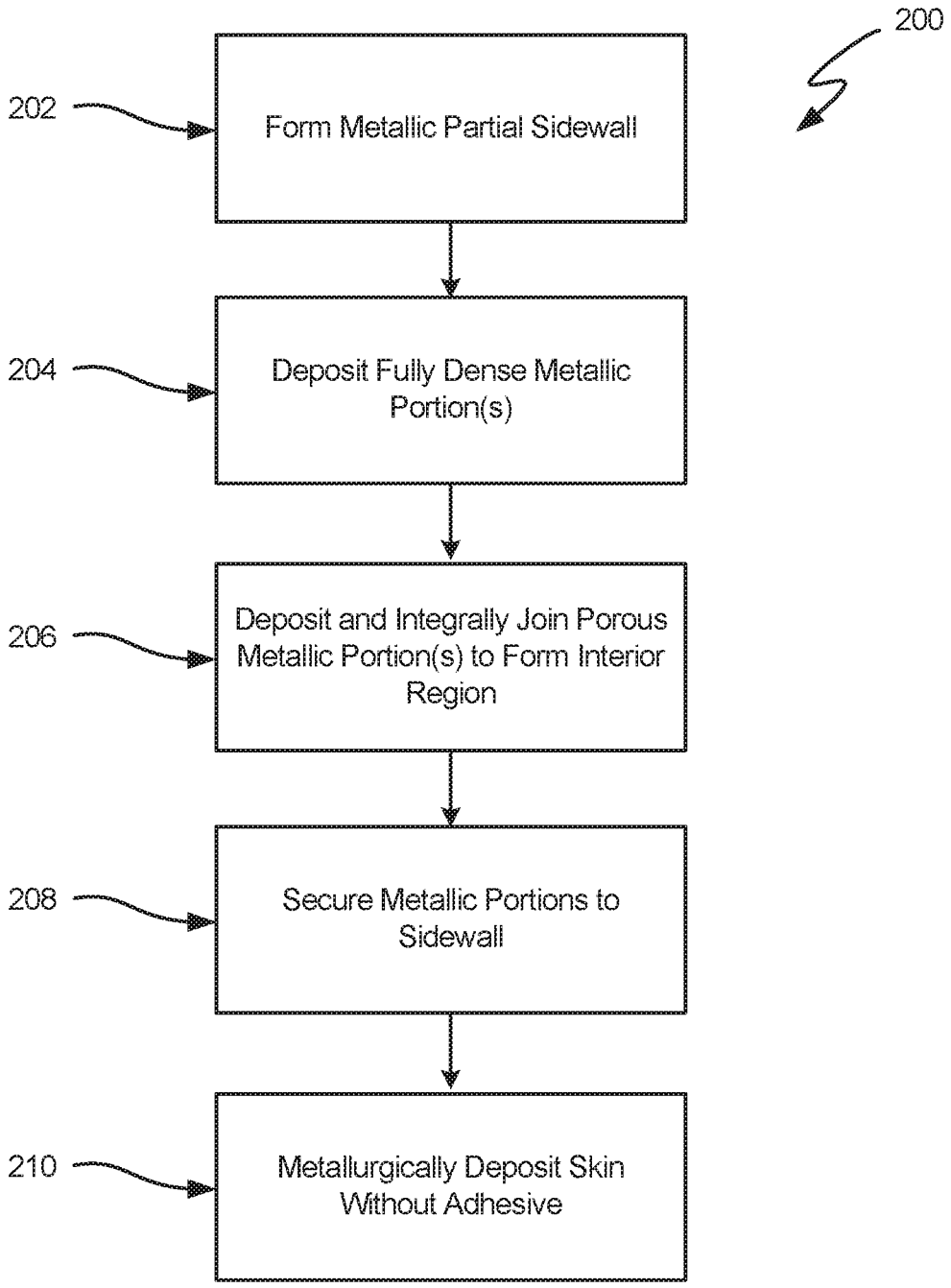
FIG. 8 is a flow chart showing steps of a method for making a fan blade according to the disclosure.

FIG. 8 is a flow chart of an example method 200 of making a fan blade according to the disclosure. Step 202 includes forming at least a portion of a metallic pressure sidewall or a metallic suction sidewall, such as in FIG. 1 where the sidewall extends in span from a base to a tip, and extends in chord from a leading edge to a trailing edge.

Next, at step 204, on the first sidewall, a first fully dense metallic portion having substantially no porosity is deposited. Step 206 includes depositing and integrally joining a first porous metallic portion to the fully dense metallic portion. As in the previous examples, the first (and subsequent) porous metallic portions can be selected from a structured lattice, an unstructured or stochastic foam, and combinations thereof. The first fully dense metallic portion and the first porous metallic portion are metallurgically secured to an interior surface of the selected pressure or suction sidewall at step 208, thereby defining at least part of an interior airfoil region. The fully dense metallic portion has a volume occupying at least 10% of a total volume of the interior region. Finally at step 210, a skin is metallurgically deposited onto at least the first porous portion without adhesive. In certain embodiments, metallurgically depositing and bonding the skin includes depositing the other of the suction sidewall and the pressure sidewall via at least one additive manufacturing process.

The lattice or foam and especially their cellular structure can be designed and topology optimized to tailor the natural frequency, enhance the bending and fatigue strength, increase resistance to foreign object damage (FOD) and customized to reduce the blade weight. Using topology optimization, the lattice or the foam can be designed with continuously variable density with fully dense thin layer at specific locations. The lattice structure can be optimally graded for both the service loadings and the manufacturing loadings. That is, the lattice can be tailored to optimally balance strength, stiffness, natural frequency, and other requirements required for rotation in the engine with those required to support the tool forces during the fabrication process.

Returning primarily to steps 204 and 206, the first porous metallic portion can be formed to have continuously variable porosity in at least one of a spanwise, chordwise, or thickness direction of the airfoil. Depositing the structured lattice includes forming a first plurality of lattice unit cells, defined by a first plurality of ligaments connected at a first plurality of nodes. Forming the first plurality of lattice unit cells includes distributing the first plurality of lattice unit cells in all of the spanwise, chordwise, and thickness directions of the airfoil.

The cross sectional geometry normal to the primary blade axis A or build axis B may or may not be constant along the entire axis length. A variation in the cross section may cause the structure to continuously and smoothly transform along the primary axis A or B. A variation in the cross section may cause sudden changes in the geometry such as is shown in FIG. 7D.

Depositing the structured lattice additionally and/or alternatively includes varying a volume of the first plurality of nodes to include nodes having at least a first volume and nodes having a second volume different from the first volume. Depositing the structured lattice also can include, in certain embodiments, varying a ligament diameter along at least one of a primary build axis B and a plane normal to a primary build axis B.

Depositing the first fully dense metallic portion and the integrally joined first porous metallic portion is performed by one or more of a laser powder bed fusion process, a wire-based electron beam additive manufacturing process, and an investment casting process. The investment casting process includes forming an investment casting core by an additive manufacturing process such as laser additive manufacturing of metallic components. Non-limiting examples of such a process, and apparatus therefore include Large Area Maskless Photopolymerization (LAMP), an additive manufacturing technology that directly produces complex ceramic cores and integral-cored shell molds for airfoil investment casting from CAD files by selectively curing ceramic-loaded photocurable resins layer-by-layer. A non-limiting example of a suitable apparatus includes an ExOne® device by The ExOne Company of North Huntingdon, Pa. The ExOne® process utilizes binder jetting technology to build functional 3D objects from the bottom up, one layer at a time with industrial-strength materials to build either casting molds or direct metal fabrication.

A lattice/cellular structure produced by laser powder bed fusion can be aligned with the build direction or axis B, so that overhanging ligaments (i.e., ligaments violating a critical overhang angle) are not present, thus allowing long (>4 mm) ligaments to be used in the interior structure. This may be accomplished, for example, by using lattice unit cells with up to 45° orientation of all ligaments to the build direction B, thereby allowing ligaments to meet at angles up to 90° to facilitate additive deposition of the skin layer(s). The structure may be tailored for abrasive flow machining, electrochemical machining, mechanical agitation, or other surface finishing technology in addition to other requirements to provide excellent surface finish for damage resistance (e.g., high-cycle fatigue).

The resulting structured lattice 44 can be fully 3D and structured, consisting of nodes connected by discrete ligaments with varying or constant density. Alternatively, a quasi-3D structure can include a set of continuous channels divided by walls along a primary axis, with individual channels taking any cross-sectional shape (e.g., honeycomb structure).

This process can allow deposition of titanium or aluminum alloy skin layer (step 210) of about 0.08" thickness covering the fan blade lattice or foam core. Deposition can use either solid state or powder/wire fusion additive manufacturing processes. The skin surface will be machined using 5-axis CNC milling machine spindle. The exact process parameters will be defined based on the selected material for the skin and AM processes.

In addition to deposition of either titanium or aluminum alloy skin on the lattice or foam core fan blade body the skin can also be made of aluminum matrix composite, incorporating a powder or wire of aluminum filled with silicon carbide particulates or nanotubes.

Optimization of the proposed processing parameters in the case of solid state deposition provide adequate quality of solid state bonding between the feedstock and the foam or cellular core structure. The processing parameters such as rotating speed (W), the traverse speed (V) and applied normal load (F) for layer deposition will be changed during deposition on top of internal structure depending the bending strength and density. A preheating system of the consumable rod can be designed to control the required normal load and generated temperature. The core cellular structure can be designed with continuously variable density and a fully dense thin layer adjacent to the core surface.

Solid state additive manufacturing processes enable the deposition of the titanium or aluminum skin layer directly on the cellular core without the need of multiple adhesive and welding processes, which will effectively eliminate the current assembly process. Because of the lack of aluminum melting when a solid state process is used, there will be no phase transformation around the skin, and the microstructure gradient in the deposited layer can be controlled as a function of the rotating speed and applied normal load. The solid state additive manufacturing process produces porosity free layers with high interfacial bond strength.

Discussion of Possible Embodiments

The following are non-exclusive descriptions of possible embodiments of the present invention.

An embodiment of a fan blade includes an interior region between a metallic pressure sidewall and a metallic suction sidewall. Each sidewall extends in span from a base to a tip, and extends in chord from a leading edge to a trailing edge. The interior region of the fan blade includes a first fully dense metallic portion and a first porous metallic portion. The first fully dense metallic portion has a volume occupying at least 10% of a total volume of the interior region, and substantially no porosity. The first porous metallic portion is integrally joined to the fully dense metallic portion, and is selected from a structured lattice, an unstructured foam, and combinations thereof.

The fan blade of the preceding paragraph can optionally include, additionally and/or alternatively, any one or more of the following features, configurations and/or additional components:

A fan blade according to an exemplary embodiment of this disclosure, among other possible things includes a metallic pressure sidewall and a metallic suction sidewall, each sidewall extending in span from a base to a tip, and extending in chord from a leading edge to a trailing edge; an interior region between the pressure and suction sidewalls, the interior region of the fan blade comprising: a first fully dense metallic portion having a volume occupying at least 10% of a total volume of the interior region, the fully dense metallic portion having substantially no porosity; and a first porous metallic portion integrally joined to the fully dense metallic portion, the first porous metallic portion selected from a structured lattice, an unstructured foam, and combinations thereof.

A further embodiment of the foregoing fan blade, wherein the first porous metallic portion has continuously variable density in at least one of a spanwise, chordwise, or thickness direction.

A further embodiment of any of the foregoing fan blades, wherein the structured lattice includes a first plurality of lattice unit cells defined by a first plurality of ligaments connected at a first plurality of nodes.

A further embodiment of any of the foregoing fan blades, wherein the first plurality of nodes are distributed in all of the spanwise, chordwise, and thickness directions of the fan blade.

A further embodiment of any of the foregoing fan blades, wherein the first plurality of nodes define a first plurality of open unit cells) each node having lattice material occupying a first volume and each unit cell having porosity occupying a first unit cell volume.

A further embodiment of any of the foregoing fan blades, wherein the first plurality of ligaments includes first ligaments having a first diameter and second ligaments having a second diameter different from the first diameter.

A further embodiment of any of the foregoing fan blades, wherein a ligament diameter varies along a length of a primary blade axis A or a primary build axis B.

A further embodiment of any of the foregoing fan blades, wherein a ligament diameter varies in a plane normal to a primary blade axis A or a primary build axis B.

A further embodiment of any of the foregoing fan blades, wherein a pair of the first plurality of ligaments converge at a node at an angle of no more than 90°.

A further embodiment of any of the foregoing fan blades, further comprising a skin metallurgically deposited onto at least the first porous portion without adhesive, the skin forming at least a portion of the suction sidewall, the pressure sidewall, or a combination thereof.

A further embodiment of any of the foregoing fan blades, wherein the structured lattice includes of at least one individual ligament having a diameter varying along its length.

A further embodiment of any of the foregoing fan blades, wherein the structured lattice comprises a fully three-dimensional (3D) lattice, a quasi-3D lattice based on a two-dimensional (2D) cross-section, or a combination thereof.

An embodiment of a method includes forming a metallic pressure sidewall or a metallic suction sidewall, the sidewall extending in span from a base to a tip, and extending in chord from a leading edge to a trailing edge. A first fully dense metallic portion having substantially no porosity is deposited. A first porous metallic portion is deposited and integrally joined to the fully dense metallic portion. The first porous metallic portion is selected from a structured lattice, an unstructured foam, and combinations thereof. The first fully dense metallic portion and the first porous metallic portion are metallurgically secured to an interior surface of the pressure or suction sidewall, defining at least part of an interior airfoil region.

The method of the preceding paragraph can optionally include, additionally and/or alternatively, any one or more of the following features, configurations and/or additional components:

A method according to an exemplary embodiment of this disclosure, among other possible things includes forming a metallic pressure sidewall or a metallic suction sidewall, the sidewall extending in span from a base to a tip, and extending in chord from a leading edge to a trailing edge; depositing a first fully dense metallic portion having substantially no porosity; depositing and integrally joined a first porous metallic portion to the fully dense metallic portion, the first porous metallic portion selected from a structured lattice, an unstructured foam, and combinations thereof; and metallurgically securing the first fully dense metallic portion and the first porous metallic portion to an interior surface of the pressure or suction sidewall, defining at least part of an interior airfoil region.

A further embodiment of the foregoing method, wherein the fully dense metallic portion has a volume occupying at least 10% of a total volume of the interior region.

A further embodiment of any of the foregoing methods, wherein the first porous metallic portion is formed to have continuously variable porosity in at least one of a spanwise, chordwise, or thickness direction of the airfoil.

A further embodiment of any of the foregoing methods, wherein depositing the structured lattice includes forming a first plurality of lattice unit cells, defined by a first plurality of ligaments connected at a first plurality of nodes.

A further embodiment of any of the foregoing methods, wherein forming the first plurality of lattice unit cells includes distributing the first plurality of lattice unit cells in all of the spanwise, chordwise, and thickness directions of the airfoil.

A further embodiment of any of the foregoing methods, wherein depositing the structured lattice includes varying a volume of the first plurality of nodes to include nodes having at least a first volume and nodes having a second volume different from the first volume.

A further embodiment of any of the foregoing methods, wherein depositing the structured lattice includes varying a diameter of adjacent ligaments along at least one of a primary build axis and a plane normal to a primary build axis.

A further embodiment of any of the foregoing methods, wherein depositing the structured lattice includes varying a diameter of at least one individual ligament along its length.

A further embodiment of any of the foregoing methods, further comprising metallurgically depositing a skin onto at least the first porous portion without adhesive, the skin forming at least a portion of the suction sidewall, the pressure sidewall, or a combination thereof.

A further embodiment of any of the foregoing methods, wherein depositing the first fully dense metallic portion and the integrally joined first porous metallic portion is performed by one or more of: a laser powder bed fusion process, a directed energy powder deposition process, a wire-based electron beam additive manufacturing process, a wire arc additive manufacturing process, an ultrasonic additive manufacturing process, and an investment casting process.

A further embodiment of any of the foregoing methods, wherein a cellular structure of the first porous metallic portion is produced by one or more of: a laser powder bed fusion process, a directed energy powder deposition process, a wire arc additive manufacturing process, an ultrasonic additive manufacturing process, and a wire-based electron beam additive manufacturing process; and wherein the structured lattice is aligned with a build direction of the airfoil.

A further embodiment of any of the foregoing methods, wherein a cellular structure of the first porous metallic portion includes ligaments of at least 4 mm and lattice unit cells with up to 45° orientation of all ligaments to the build direction such that a pair of the first plurality of ligaments converge at a node at an angle of no more than 90°.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fan blade comprising:

a metallic pressure sidewall and a metallic suction sidewall, each sidewall extending in span from a base to a tip, and extending in chord from a leading edge to a trailing edge;

an interior region defined by a total volume between the pressure and suction sidewalls, the interior region of the fan blade comprising:

a first fully dense metallic portion having a volume occupying at least 10% of the total volume of the interior region, spaced from the pressure and suction sidewalls, the fully dense metallic portion having substantially no porosity; and a first porous metallic portion integrally joined to the fully dense metallic portion, the first porous metallic portion selected from a structured lattice, an unstructured foam, and combinations thereof;

wherein the structured lattice includes a first plurality of lattice unit cells defined by a first plurality of ligaments connected at a first plurality of nodes;

wherein the first plurality of ligaments includes first ligaments have a first diameter and second ligaments have a second diameter different from the first diameter.

2. The fan blade of claim 1, wherein the first porous metallic portion has continuously variable density in at least one of a spanwise, chordwise, or thickness direction.

3. The fan blade of claim 1, wherein the first plurality of nodes are distributed in all of the spanwise, chordwise, and thickness directions of the fan blade.

4. The fan blade of claim 1, wherein the first plurality of nodes define a first plurality of open unit cells) each node having lattice material occupying a first volume and each unit cell having porosity occupying a first unit cell volume.

5. The fan blade of claim 1, wherein a ligament diameter varies along a length of a primary blade axis A or a primary build axis B.

6. The fan blade of claim 1, wherein a ligament diameter varies in a plane normal to a primary blade axis A or a primary build axis B.

7. The fan blade of claim 1, wherein a pair of the first plurality of ligaments converge at a node at an angle of no more than 90°.

8. The fan blade of claim 1, further comprising:

a skin metallurgically deposited onto at least the first porous portion without adhesive, the skin forming at least a portion of the suction sidewall, the pressure sidewall, or a combination thereof.

9. The fan blade of claim 1, wherein the structured lattice includes of at least one individual ligament having a diameter varying along its length.

10. The fan blade of claim 1, wherein the structured lattice comprises a fully three-dimensional (3D) lattice, a quasi-3D lattice based on a two-dimensional (2D) cross-section, or a combination thereof.

11. A method comprising:

forming a metallic pressure sidewall or a metallic suction sidewall, the sidewall extending in span from a base to a tip, and extending in chord from a leading edge to a trailing edge, together defining a total volume of an interior airfoil region;

depositing a first fully dense metallic portion having substantially no porosity;

depositing and integrally joined a first porous metallic portion to the fully dense metallic portion, the first porous metallic portion selected from a structured lattice, an unstructured foam, and combinations thereof; and metallurgically securing the integrally joined first fully dense metallic portion and the first porous metallic portion to at least one part of the interior airfoil region;

wherein depositing the structured lattice includes forming a first plurality of lattice unit cells, defined by a first plurality of ligaments connected at a first plurality of nodes;

wherein the first plurality of ligaments includes first ligaments have a first diameter and second ligaments have a second diameter different from the first diameter.

12. The method of claim 11, wherein the fully dense metallic portion has a volume occupying at least 10% of the total volume of the interior region.

13. The method of claim 11, wherein the first porous metallic portion is formed to have continuously variable porosity in at least one of a spanwise, chordwise, or thickness direction of the interior airfoil region.

14. The method of claim 11, wherein forming the first plurality of lattice unit cells includes distributing the first plurality of lattice unit cells in all of the spanwise, chordwise, and thickness directions of the airfoil.

15. The method of claim 11, wherein depositing the structured lattice includes varying a volume of the first plurality of nodes to include nodes having at least a first volume and nodes having a second volume different from the first volume.

16. The method of claim 11, wherein depositing the structured lattice includes varying diameter of adjacent ligaments along at least one of a primary build axis and a plane normal to a primary build axis.

17. The method of claim 11, wherein depositing the structured lattice includes varying a diameter of at least one individual ligament along its length.

18. The method of claim 11, further comprising metallurgically depositing a skin onto at least the first porous portion without adhesive, the skin forming at least a portion of the suction sidewall, the pressure sidewall, or a combination thereof.

19. The method of claim 11, wherein depositing the first fully dense metallic portion and the integrally joined first porous metallic portion is performed by one or more of: a laser powder bed fusion process, a directed energy powder deposition process, a wire-based electron beam additive manufacturing process, a wire arc additive manufacturing process, an ultrasonic additive manufacturing process, and an investment casting process.

20. The method of claim 18, wherein a cellular structure of the first porous metallic portion is produced by one or more of: a laser powder bed fusion process, a directed energy powder deposition process, a wire arc additive manufacturing process, an ultrasonic additive manufacturing process, and a wire-based electron beam additive manufacturing process; and wherein the structured lattice is aligned with a build direction of the airfoil.

21. The method of claim 20, wherein a cellular structure of the first porous metallic portion includes ligaments of at least 4 mm and lattice unit cells with up to 45° orientation of all ligaments to the build direction such that a pair of the first plurality of ligaments converge at a node at an angle of no more than 90°.

* * * * *